US010230144B2

(12) United States Patent
Yoshida

(10) Patent No.: US 10,230,144 B2
(45) Date of Patent: Mar. 12, 2019

(54) FILTER, BRANCHING FILTER, WIRELESS COMMUNICATION MODULE, BASE STATION, AND CONTROL METHOD

(71) Applicant: NEC Corporation, Tokyo (JP)

(72) Inventor: Manabu Yoshida, Tokyo (JP)

(73) Assignee: NEC Corporation, Tokyo (JP)

( * ) Notice: Subject to any disclaimer, the term of this patent is extended or adjusted under 35 U.S.C. 154(b) by 25 days.

(21) Appl. No.: 15/328,211

(22) PCT Filed: Mar. 20, 2015

(86) PCT No.: PCT/JP2015/001582
§ 371 (c)(1),
(2) Date: Jan. 23, 2017

(87) PCT Pub. No.: WO2016/013135
PCT Pub. Date: Jan. 28, 2016

(65) Prior Publication Data

US 2017/0237137 A1 Aug. 17, 2017

(30) Foreign Application Priority Data

Jul. 24, 2014 (JP) ..... 2014-150830

(51) Int. Cl.
*H01P 5/18* (2006.01)
*H01P 7/10* (2006.01)
(Continued)

(52) U.S. Cl.
CPC ..... *H01P 1/207* (2013.01); *H01P 1/202* (2013.01); *H01P 1/2084* (2013.01); *H01P 1/213* (2013.01); *H01P 5/182* (2013.01); *H01P 7/10* (2013.01)

(58) Field of Classification Search
CPC ..... H01P 1/207; H01P 5/182; H01P 7/10
See application file for complete search history.

(56) References Cited

U.S. PATENT DOCUMENTS

2001/0052833 A1* 12/2001 Enokihara ..... H01P 1/2084 333/202
2002/0118080 A1* 8/2002 Saito ..... H01P 1/2086 333/202
2011/0021155 A1 1/2011 Ozaki et al.

FOREIGN PATENT DOCUMENTS

JP 57-106201 7/1982
JP 60-192502 12/1985
(Continued)

OTHER PUBLICATIONS

Y. Kobayashi et al., "Bandpass Filters Using $TM_{010}$ Dielectric Rod Resonators", Microwave Symposium Digest, IEEE-MTT-S International, pp. 233-235, 1978.
(Continued)

*Primary Examiner* — Robert J Pascal
*Assistant Examiner* — Kimberly E Glenn
(74) *Attorney, Agent, or Firm* — Finnegan, Henderson, Farabow, Garrett & Dunner, L.L.P.

(57) ABSTRACT

A profile-reduced or size-reduced filter is to be provided. The filter includes: a metallic casing, an opening provided in the metallic casing, a metallic cover configured to cover the opening, and a TM mode dielectric resonator disposed in the opening and configured to electrically contact a bottom surface of the metallic casing, and the metallic cover. The TM mode dielectric resonator has a height lower than a lowest possible height at which a ¼ wavelength semi-coaxial resonator is disposed in the opening.

5 Claims, 13 Drawing Sheets

(51) Int. Cl.

| | |
|---|---|
| ***H01P 1/202*** | (2006.01) |
| ***H01P 1/207*** | (2006.01) |
| ***H01P 1/208*** | (2006.01) |
| ***H01P 1/213*** | (2006.01) |

(56) References Cited

FOREIGN PATENT DOCUMENTS

| | | | | |
|---|---|---|---|---|
| JP | 63-232602 | | | 9/1988 |
| JP | 2002009502 | A | * | 1/2002 |
| JP | 2002-84102 | | | 3/2002 |
| JP | 2002-158514 | | | 5/2002 |
| JP | 2005-73242 | | | 3/2005 |
| JP | 2011-29996 | | | 2/2011 |

OTHER PUBLICATIONS

International Search Report and Written Opinion dated May 12, 2015, in corresponding PCT International Application.

* cited by examiner

FILTER, BRANCHING FILTER, WIRELESS COMMUNICATION MODULE, BASE STATION, AND CONTROL METHOD

CROSS-REFERENCE TO RELATED PATENT APPLICATIONS

This application is a National Stage Entry of International Application No. PCT/JP2015/001582, filed Mar. 20, 2015, which claims priority from Japanese Patent Application No. 2014-150830, filed Jul. 24, 2014. The entire contents of the above-referenced applications are expressly incorporated herein by reference.

TECHNICAL FIELD

The present invention relates to a filter, a branching filter, a wireless communication module, a base station, and a control method.

BACKGROUND ART

A wireless device, such as a base station, in a wireless communication system includes a filter having a resonator.

PTL 1 discloses a filter using a dielectric resonance element which stably operates even when a temperature change occurs. In PTL 1, when the dielectric resonance element is stretched in the height direction thereof due to a change in ambient temperature, a mechanism for absorbing the stretched portion is provided at a metallic cover that houses the dielectric resonance element.

CITATION LIST

Patent Literature

PTL 1: Japanese Unexamined Patent Application Publication No. 2005-73242

SUMMARY OF INVENTION

Technical Problem

In PTL 1, however, since the mechanism is provided to deal with fluctuations in resonance frequency or Q-value due to a temperature change, the dielectric resonance element is configured such that the dielectric resonance element is extended not in the radius direction but in the height direction thereof. This causes a problem that a size of the filter increases.

An object of an exemplary embodiment is to provide a low-profile or miniaturized filter, a branching filter, a wireless communication module, a base station, and a control method. It is to be noted that this object is merely one of a plurality of objects to be achieved by the exemplary embodiment disclosed herein. Other objects or problems and novel features of the invention will become apparent from the following descriptions and the accompanying drawings.

Solution to Problem

A filter according to an exemplary embodiment includes: a metallic casing; an opening provided in the metallic casing; a metallic cover configured to cover the opening; and a TM mode dielectric resonator disposed in the opening and configured to electrically contact a bottom surface of the metallic casing and the metallic cover. In the filter, the TM mode dielectric resonator has a height lower than the lowest possible height at which a ¼ wavelength semi-coaxial resonator is disposed in the opening.

A control method for a filter according to an exemplary embodiment is a control method for a filter including: a metallic casing; an opening provided in the metallic casing; a metallic cover configured to cover the opening; and a TM mode dielectric resonator disposed in the opening and configured to electrically contact a bottom surface of the metallic casing and the metallic cover. The control method includes: inputting a signal to the filter; filtering the signal input to the filter; and outputting the filtered signal. In the filter in the control method, the TM mode dielectric resonator has a height lower than the lowest possible height at which a ¼ wavelength semi-coaxial resonator is disposed in the opening.

A filter according to an exemplary embodiment includes: a metallic casing; an opening provided in the metallic casing; a metallic cover configured to cover the opening; a TM mode dielectric resonator disposed in the opening and configured to electrically contact a bottom surface of the metallic casing and the metallic cover; and a ¼ wavelength semi-coaxial resonator disposed in the opening and configured to electrically contact a bottom surface of the metallic casing and the metallic cover. In the filter, the ¼ wavelength semi-coaxial resonator is used as an input or output resonator.

Advantageous Effects of Invention

According to exemplary embodiments of the present invention, it is possible to provide a low-profile or miniaturized filter, a branching filter, a wireless communication module, a base station, and a control method.

DESCRIPTION OF EMBODIMENTS

Figure 1:
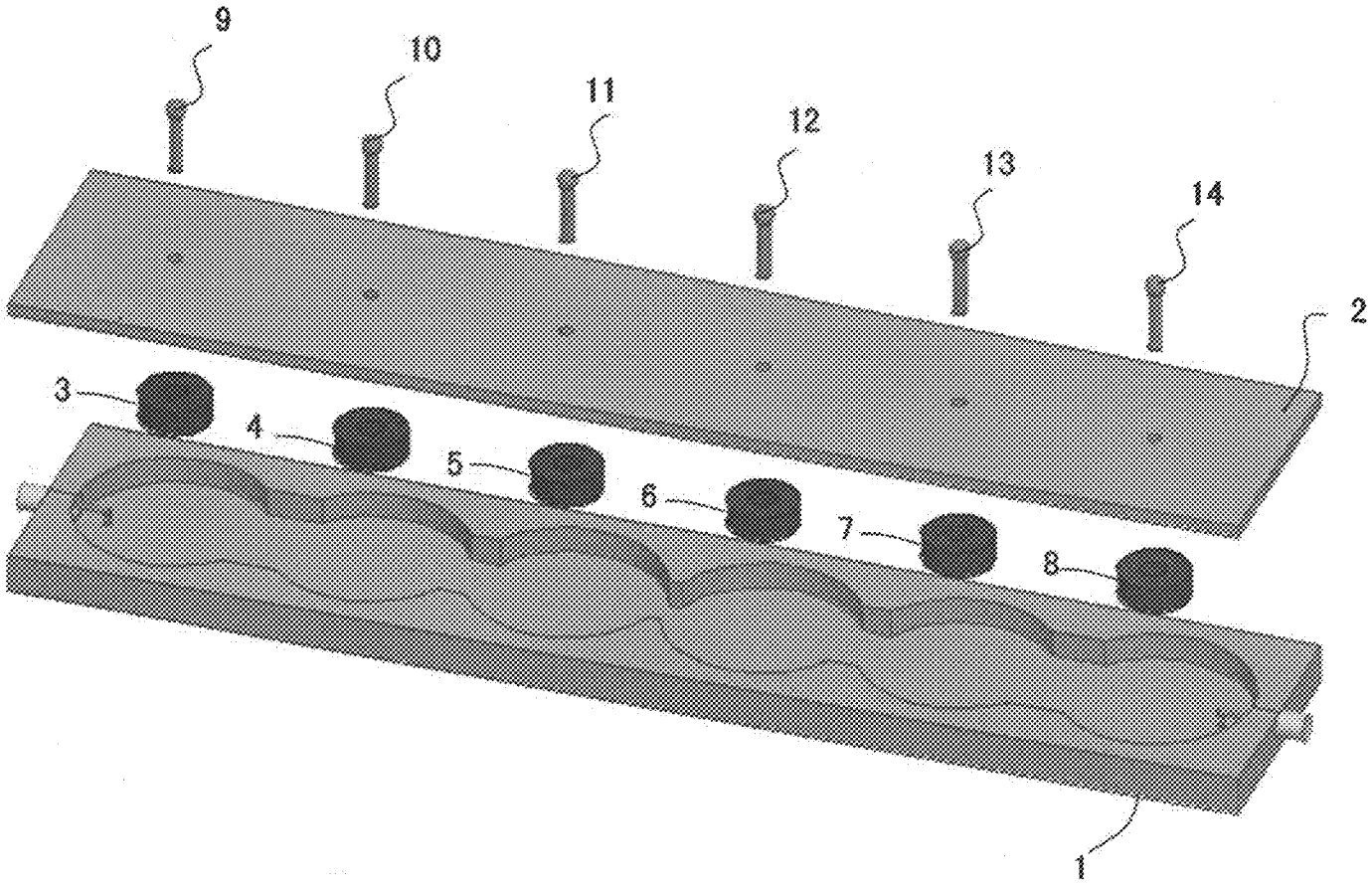
FIG. 1 is a perspective view of a filter according to a first exemplary embodiment.

Specific exemplary embodiments will be described in detail below with reference to the drawings. In the respective drawings, the same or corresponding elements are given the same reference numerals, and a repeated description is omitted as needed for clarity of explanation.

A plurality of exemplary embodiments described below may be executed independently or in combination as appropriate. A plurality of the exemplary embodiments have different novel features. Therefore, a plurality of the exemplary embodiments contribute to solving different objects or problems, and contribute to achieving different effects.

First Exemplary Embodiment

Figure 2:
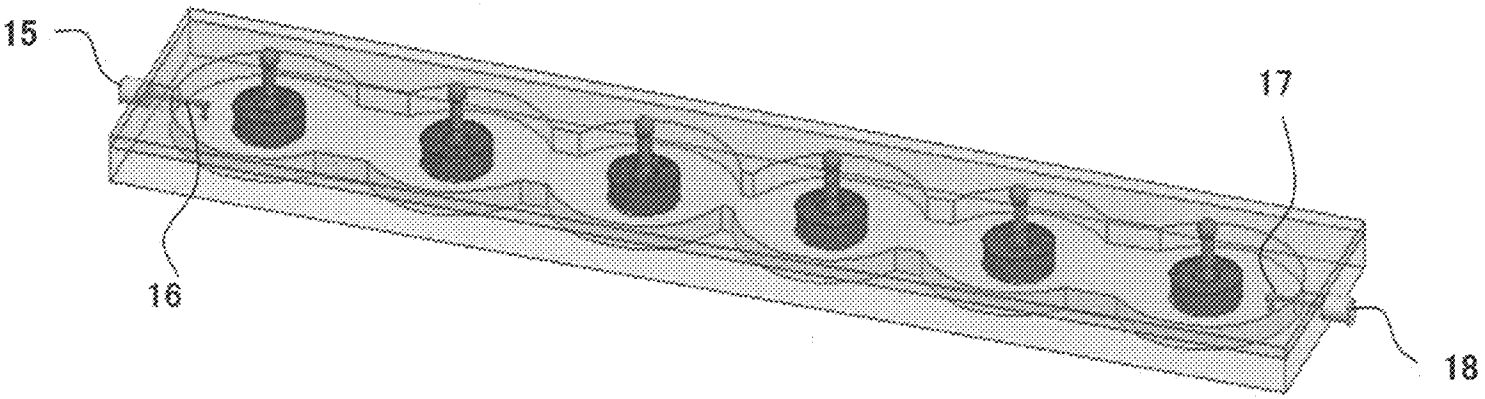
FIG. 2 is a transparent view of the filter according to the first exemplary embodiment.

FIG. 1 is a perspective view of a filter according to a first exemplary embodiment. FIG. 2 is a transparent view of FIG. 1. In the state illustrated in FIG. 2, the filter according to this exemplary embodiment operates.

The filter according to this exemplary embodiment includes a metallic casing 1 having an opening, and a metallic cover 2 that covers the opening. The filter according to this exemplary embodiment also includes TM (Transverse Magnetic) mode dielectric resonators 3 to 8 which are interposed between the metallic casing 1 and the metallic cover 2. One side surface of each of the TM mode dielectric resonators 3 to 8 electrically contacts a bottom surface portion (a bottom surface portion of the opening) of the metallic casing 1. The opposite side surface of each of the TM mode dielectric resonators 3 to 8 electrically contacts the metallic cover 2 (being mounted to maintain a contact).

The filter according to this exemplary embodiment includes frequency adjustment screws 9 to 14 which are used for adjusting resonance frequencies of the TM mode dielectric resonators 3 to 8, respectively. The filter according to this exemplary embodiment also includes an input terminal 15 and an input antenna 16 which are disposed on a side surface at one end side of the metallic casing 1 in the longitudinal direction. The filter according to this exemplary embodiment also includes an output antenna 17 and an output terminal 18 which are disposed on an opposite side surface of the side surface on which the input terminal 15 and the input antenna 16 are included.

The input terminal 15 inputs an electromagnetic wave which is excited at a desired resonance frequency f. The input antenna 16 is electromagnetically coupled to the TM mode dielectric resonator 3. The TM mode dielectric resonator 3 coupled at the resonance frequency f is electromagnetically coupled to the adjacent TM mode dielectric resonator 4. Further, the TM mode dielectric resonator 4 is electromagnetically coupled to the adjacent TM-mode dielectric resonator 5. As a result of this repeated coupling, the TM mode dielectric resonator 8 is electromagnetically coupled to the output antenna 17 at the resonance frequency f, and the electromagnetic wave excited at the resonance frequency f is output from the output terminal 18.

Figure 3:
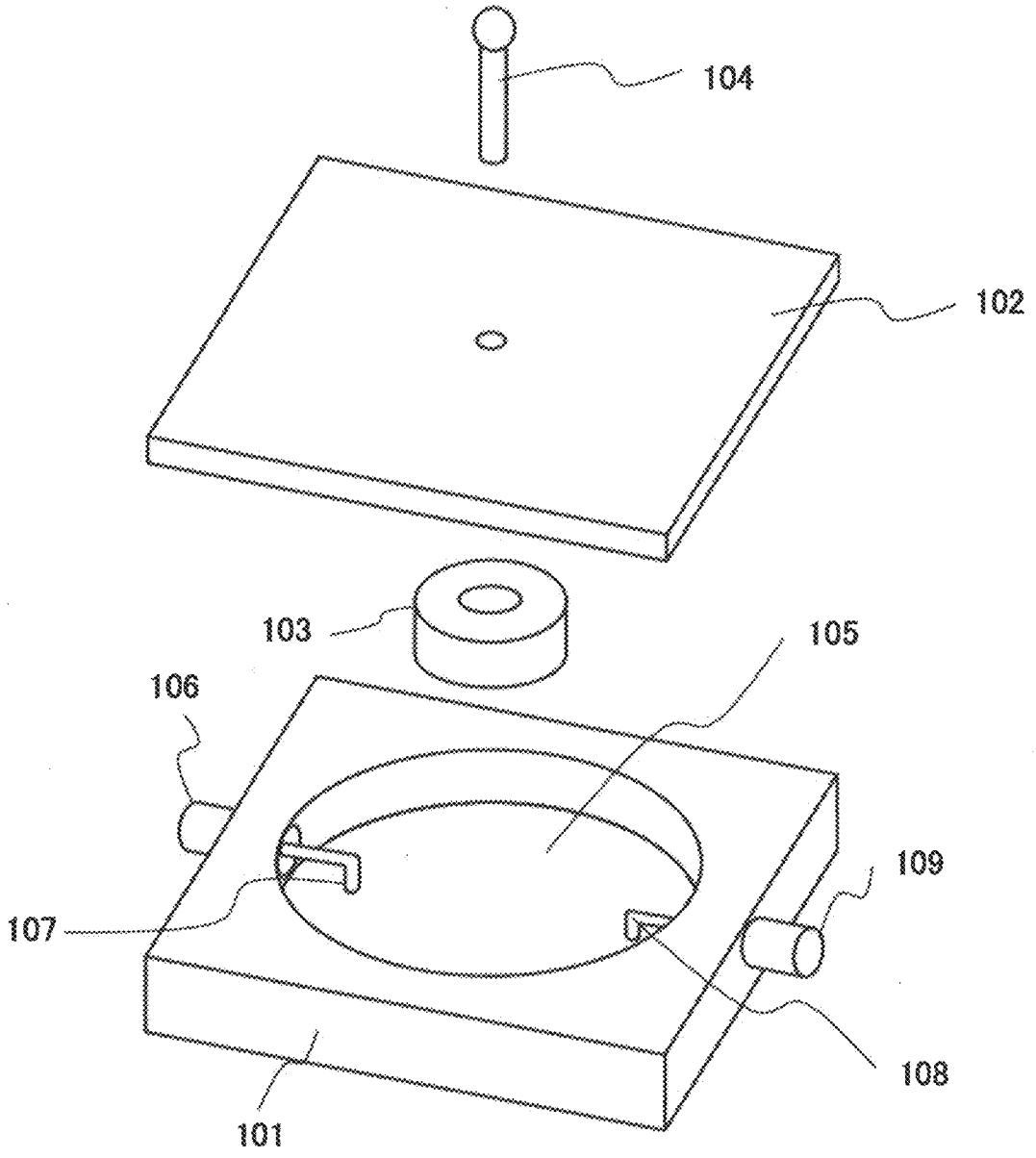
FIG. 3 is a perspective view of a filter according to a modified example of the first exemplary embodiment.

Note that in this exemplary embodiment, the number of the TM mode dielectric resonators is not limited to six. The resonance frequency f is configured by six stages. Needless to say, it is not a problem for each of the TM mode dielectric resonators to be composed of multiple stages, respectively. FIG. 3 illustrates an example of the first exemplary embodiment in which one TM mode dielectric resonator is provided.

FIG. 3 illustrates an example of the first exemplary embodiment. The filter according to this example includes one TM mode dielectric resonator. The TM mode dielectric resonator is mounted in such a manner that the TM mode dielectric resonator is interposed between the metallic casing having an opening surface and the metallic cover that covers the opening. Specifically, the TM mode dielectric resonator is mounted in such a manner that one side surface of the TM mode dielectric resonator maintains an electrical contact with a bottom surface portion of the metallic casing and the opposite side surface of the TM mode dielectric resonator maintains an electrical contact with the metallic cover. In this configuration, the resonance frequency of the TM mode dielectric resonator does not depend on the height of the TM mode dielectric resonator, but depends on the outer peripheral direction (outer diameter) of the TM mode dielectric resonator and a dielectric constant of dielectric material included in the dielectric resonator instead.

This example will be described in detail with reference to FIG. 3. The filter according to this example includes a metallic casing 101, a metallic cover 102, a TM mode dielectric resonator 103, a frequency adjustment screw 104, an opening 105, an input terminal 106, an input antenna 107, an output antenna 108, and an output terminal 109.

The metallic casing 101 is an electric conductor (conductor) (for example, a casing made of metal). The metallic casing 101 has the opening 105. The metallic cover 102 covers the opening 105. The TM mode dielectric resonator 103 has a cylindrical shape and includes a cavity. The input terminal 106 inputs an electromagnetic wave which is excited at a desired resonance frequency f1. The input antenna 107 is electromagnetically coupled to the TM mode dielectric resonator 103. The TM mode dielectric resonator 103 is electromagnetically coupled to the output antenna 108 at the resonance frequency f1, and the electromagnetic wave excited at the resonance frequency f1 is output from the output terminal 109. The frequency adjustment screw 104 is provided coaxially with the TM mode dielectric resonator 103. The frequency adjustment screw 104 adjusts the resonance frequency f1.

Figure 4:
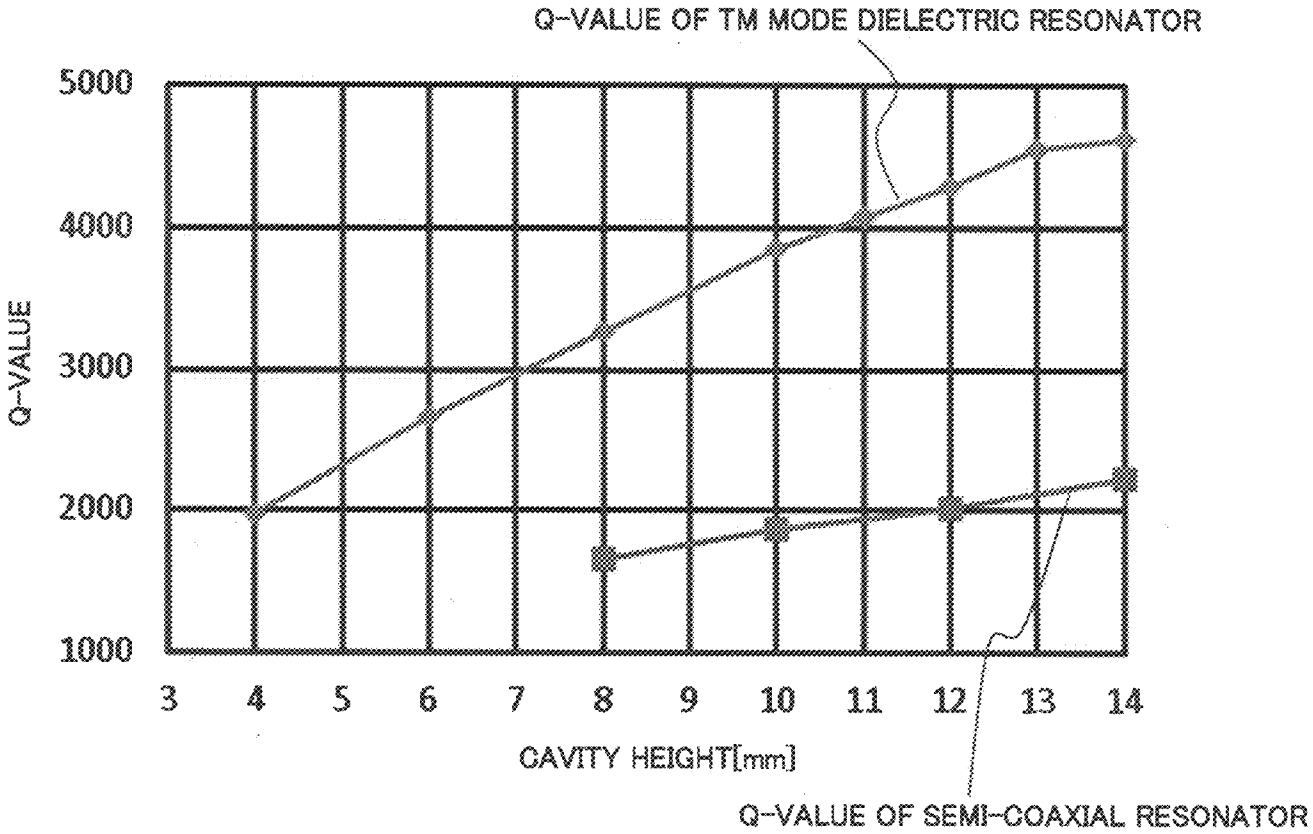
FIG. 4 is a diagram illustrating a comparison between Q-values of resonators according to the first exemplary embodiment.

FIG. 4 illustrates an example of a comparison between Q-values of the TM mode dielectric resonator and a semi-coaxial resonator (¼ wavelength dielectric resonator) when the height of cavity resonators (cavities) having the same diameter (outer diameter) is changed in a frequency band of, for example, 1.7 GHz. Assume herein that, for example, the outer diameter of the resonator is φ10 mm and the relative permittivity is about 45.

For example, when the height of the semi-coaxial resonator is 12 mm, the Q-value is 2000. On the other hand, when the height of the TM mode dielectric resonator is 4 mm, the Q-value is 2000. That is, use of the TM mode dielectric resonator makes it possible to realize a filter which has a height that is one third of a filter using a semi-coaxial resonator and which has the same Q-value as the filter using the semi-coaxial resonator. According to FIG. 4, a semi-coaxial resonator with a height of less than 8 mm cannot be used, but use of the TM mode dielectric resonator according to this exemplary embodiment makes it possible to realize a filter with a height that may not be realized when using the semi-coaxial resonator.

For example, the TM mode dielectric resonator with a height of 6 mm can obtain a Q-value that is about 1.4 times larger than that of the semi-coaxial resonator with a height of 12 mm which is twice the height of the TM mode dielectric resonator. In other words, even when the size (height) of the TM mode dielectric resonator is half of that of the semi-coaxial resonator, a miniaturized filter having an excellent Q-value as compared with the semi-coaxial resonator can be provided according to this exemplary embodiment.

The above is merely an example, and, for example, in a frequency band of 2 GHz, when the relative permittivity of the TM mode dielectric resonator is 40 and the outer diameter thereof is 9 mm, the height of the resonator may be low-profiled to about 2.0 mm. Note that the height is not limited to 2.0 mm, but the height may be changed as appropriate within a range in which the height is more than 2.0 mm and less than 32.00.

Figure 5:
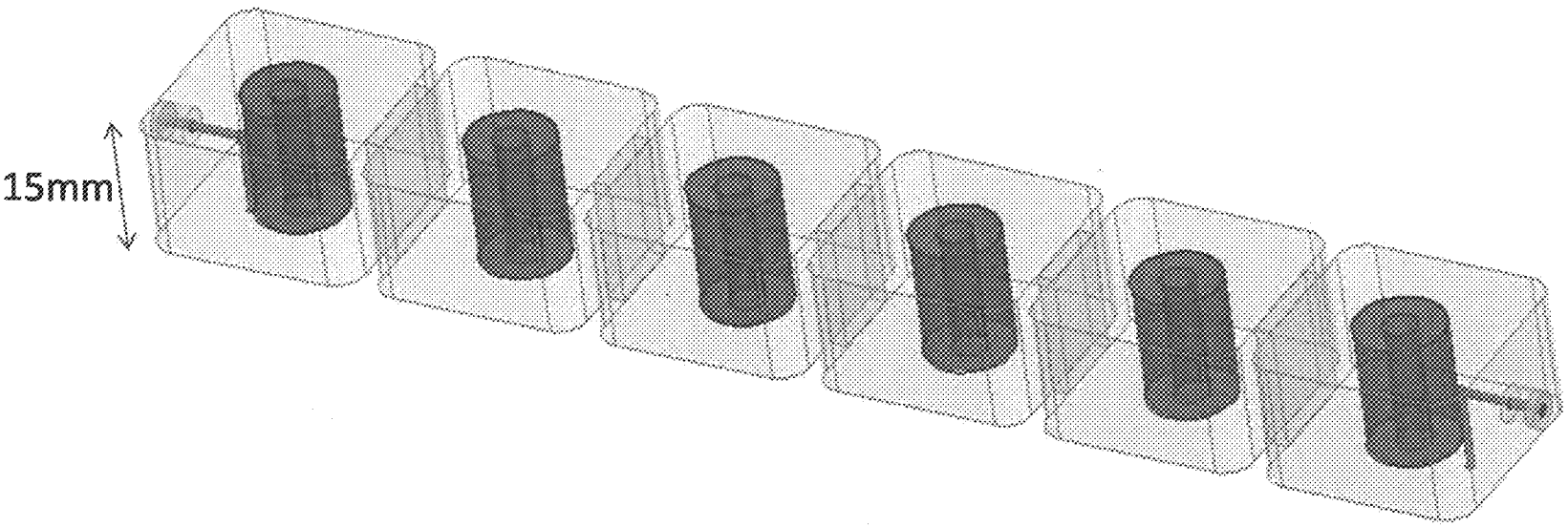
FIG. 5 is a perspective view of a filter related to a typical TM mode dielectric resonator.
Figure 6:
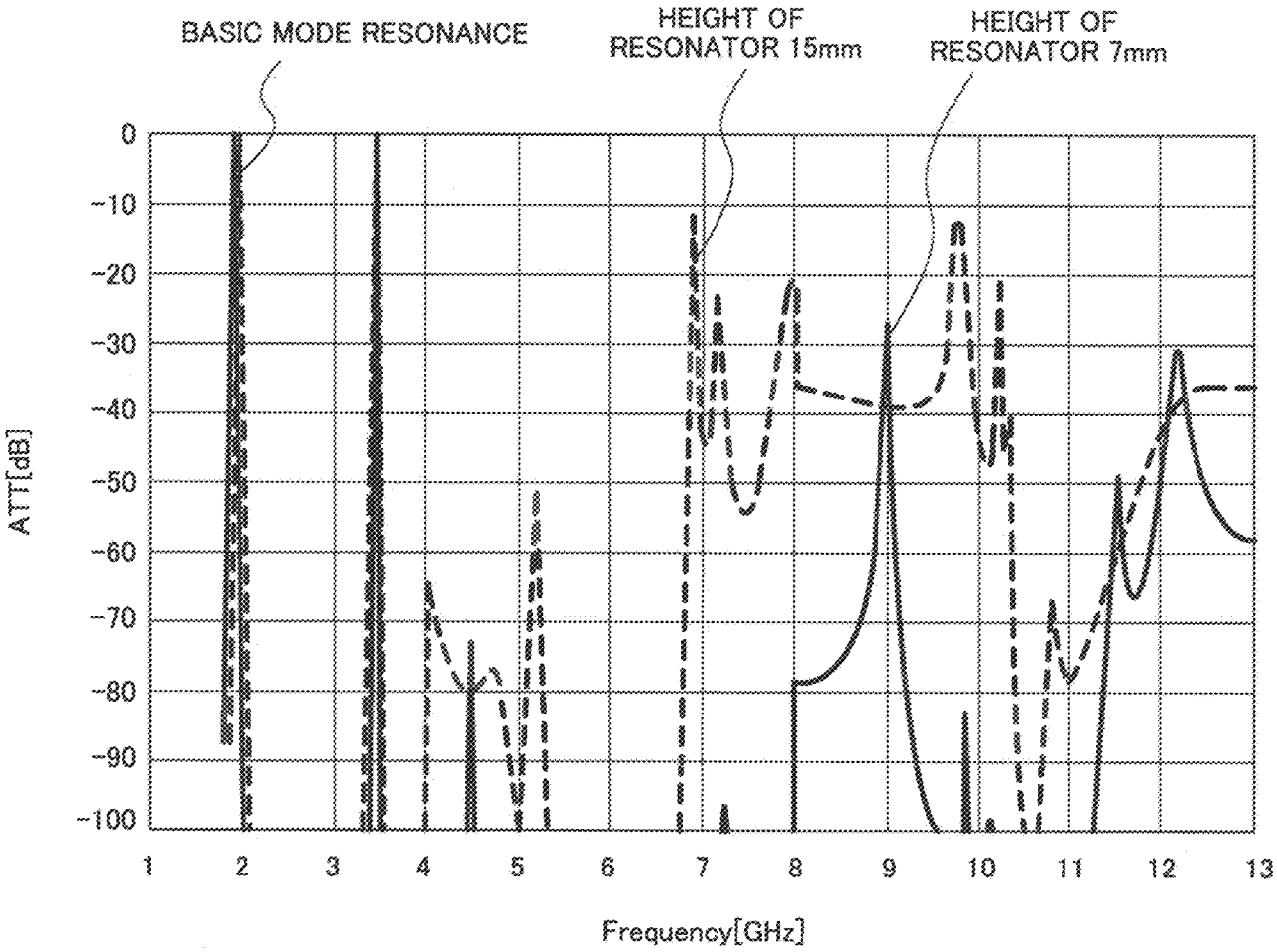
FIG. 6 is a diagram illustrating a comparison between spurious modes according to the first exemplary embodiment.

FIG. 5 illustrates a typical TM mode dielectric resonator used as a filter. FIG. 6 illustrates a comparison between spurious modes in the first exemplary embodiment.

In FIG. 6, dashed lines indicate a spurious mode when the typical TM mode dielectric resonator (with a height of 15 mm) illustrated in FIG. 5 is used. On the other hand, solid lines indicate a spurious mode when the TM mode dielectric resonator (with a height of 7 mm) according to this exemplary embodiment is used. In the typical TM mode dielectric resonator, a large spurious mode is generated as indicated by dashed lines in FIG. 6, compared with this exemplary embodiment. When another device is incorporated to suppress this spurious mode, a loss in the entire filter increases, which leads to an increase in size of the filter. On the other hand, according to the above exemplary embodiment, as indicated by solid lines in FIG. 6, a filter in which the spurious mode is suppressed more than in the typical TM mode dielectric resonator can be provided.

According to the examples illustrated in FIGS. 4 and 6, in a frequency band of 1.7 GHz, when the height of the TM mode dielectric resonator is less than 8 mm and equal to or more than 4 mm, the spurious mode is suppressed and a (low-profile) TM mode dielectric resonator having a low height that may not be achieved in the semi-coaxial resonator can be configured. Further, when the height of the TM mode dielectric resonator is equal to or more than 8 mm and less than 15 mm, the spurious mode is suppressed and the Q-value higher than that of the semi-coaxial resonator with the same height may be obtained. Note that in FIG. 4, a case where the height of the TM mode dielectric resonator is equal to or less than 4 mm is not specified, but the height of the TM mode dielectric resonator may be low-profiled to about 2 mm.

As described above, when the height of the TM mode dielectric resonator is configured to be lower than the lowest possible height at which the semi-coaxial resonator is disposed in the opening, a filter having a better Q-value than that of the semi-coaxial resonator and having a lower height than that of the semi-coaxial resonator can be configured. Further, the filter can be configured to have a lower height without sacrificing a passage loss of the filter, compared with the semi-coaxial resonator. Furthermore, the filter in which the spurious mode is more suppressed than in the TM mode dielectric resonator disclosed in PTL 1 and the typical TM mode dielectric resonator can be provided.

As described above, in this exemplary embodiment, the TM mode dielectric resonator has a low-profile height and a waveguide (a rectangular waveguide configured by the metallic casing and the metallic cover described above), in which the TM mode resonator is installed, is miniaturized, so that the spurious mode is suppressed. The waveguide herein is referred to as a cutoff waveguide, and the waveguide is included in the filter together with the TM mode dielectric resonator.

Second Exemplary Embodiment

Figure 7:
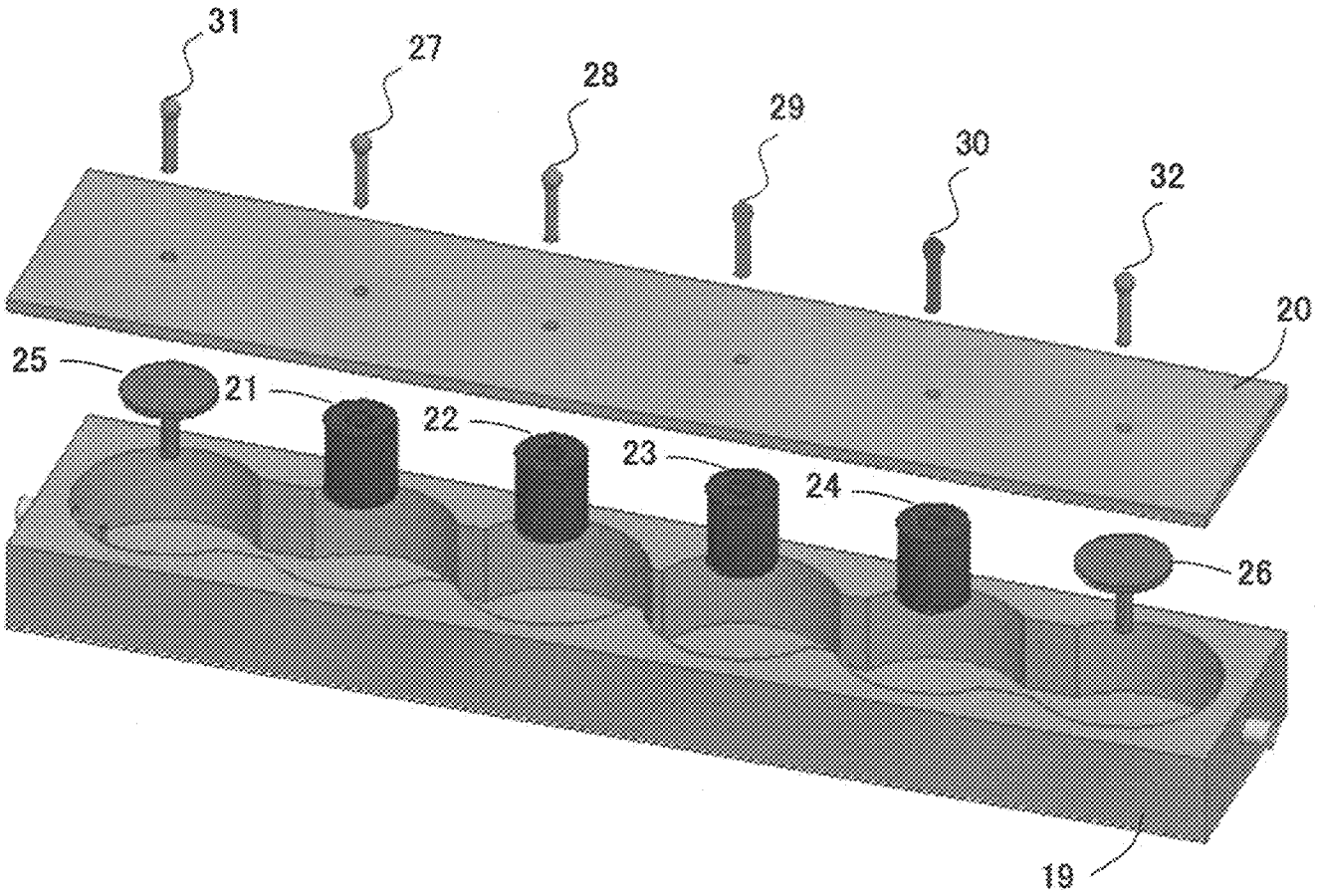
FIG. 7 is a perspective view of a filter according to a second exemplary embodiment.
Figure 8:
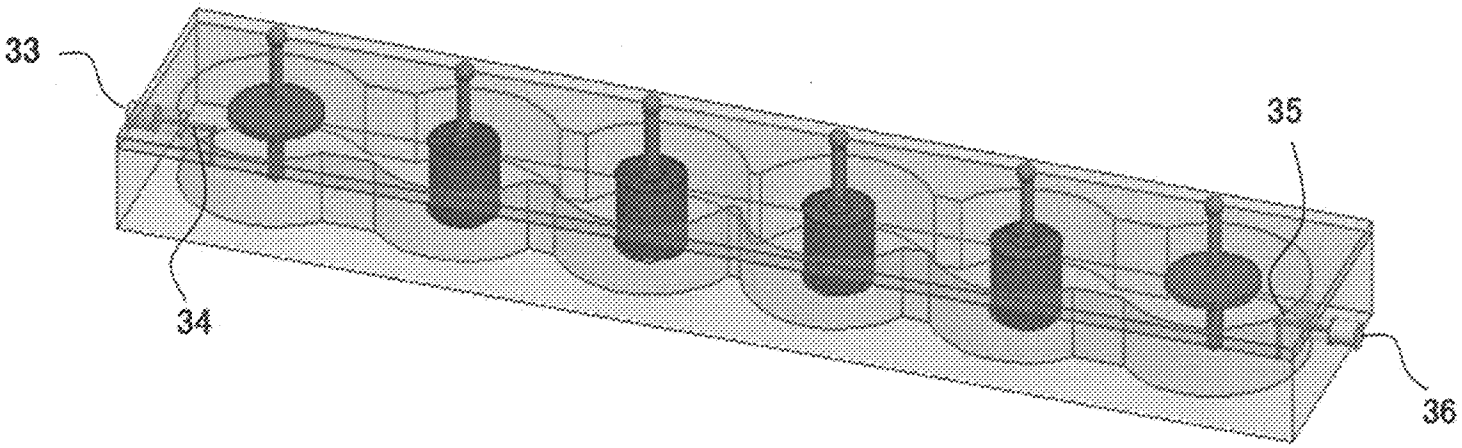
FIG. 8 is a transparent view of the filter according to the second exemplary embodiment.

FIG. 7 is a perspective view of a filter according to a second exemplary embodiment. FIG. 8 is a transparent view of FIG. 7. In the state illustrated in FIG. 8, the filter according to this exemplary embodiment operates.

The filter according to this exemplary embodiment includes a metallic casing 19 having an opening and a metallic cover 20 that covers the opening. The filter according to this exemplary embodiment also includes, as resonators other than input and output resonators, TM mode dielectric resonators 21, 22, 23, and 24 which are interposed between the metallic casing 19 and the metallic cover 20.

The filter according to this exemplary embodiment also includes a ¼ wavelength semi-coaxial resonator 25 which is composed of metal and serves as a resonator on the input-side, and a ¼ wavelength semi-coaxial resonator 26 which is composed of metal and serves as a resonator on the output-side. The filter according to this exemplary embodiment also includes frequency adjustment screws 27 to 32. The frequency adjustment screws 27 to 30 are used to adjust a resonance frequency of the TM mode dielectric resonator. The frequency adjustment screws 31 and 32 are used to adjust a resonance frequency of the ¼ wavelength dielectric resonator.

The filter according to this exemplary embodiment also includes an input terminal 33 and an input antenna 34 which are disposed on a side surface at one end side of the metallic casing 19 in the longitudinal direction. The filter according to this exemplary embodiment also includes an output antenna 35 and an output terminal 36 which are disposed on an opposite side surface of the side surface on which the input terminal 33 and the input antenna 34 are included.

The input terminal 33 inputs an electromagnetic wave which is excited at a desired resonance frequency f. The input antenna 34 is electromagnetically coupled to the input terminal 33 and the ¼ wavelength semi-coaxial resonator 25. The ¼ wavelength semi-coaxial resonator 25 coupled at the resonance frequency f is electromagnetically coupled to the adjacent TM mode dielectric resonator 21. The TM mode dielectric resonator 21 is electromagnetically coupled to the adjacent TM mode dielectric resonator 22. As a result of this repeated coupling, the resonance frequency f coupled to the ¼ wavelength semi-coaxial resonator 26 is electromagnetically coupled to the output antenna 35, and is output from the output terminal 36.

Figure 13:
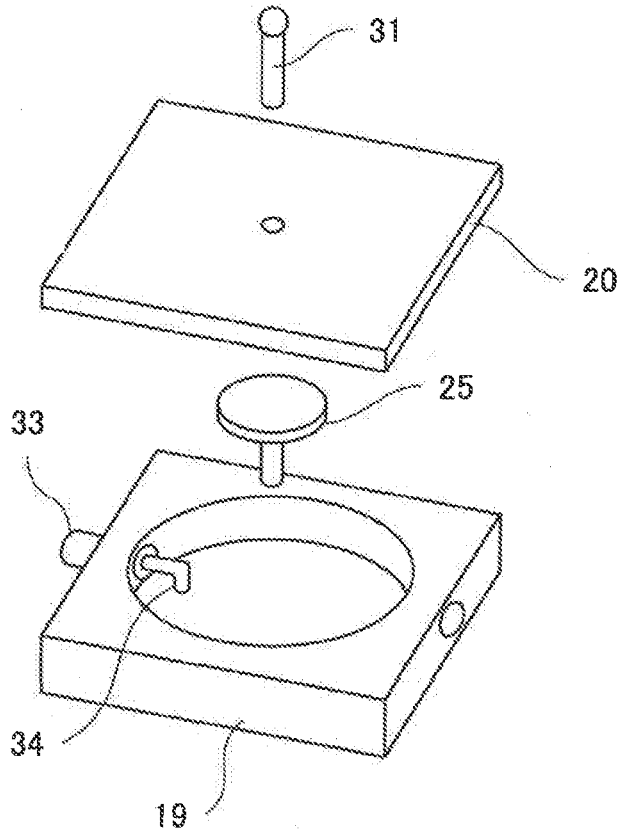
FIG. 13 is a perspective view of the ¼-wavelength semi-coaxial resonator on the input side according to a second exemplary embodiment.
Figure 14:
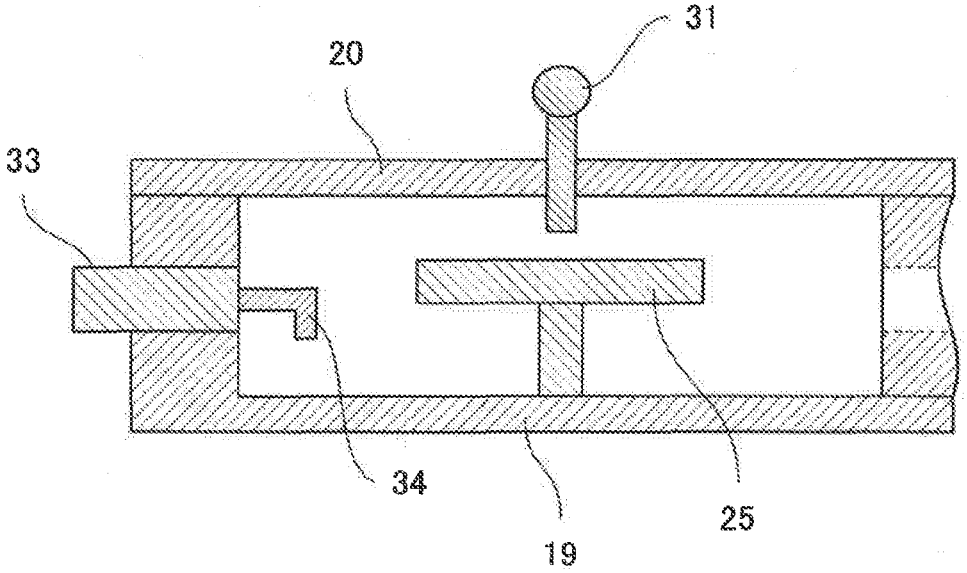
FIG. 14 is a sectional view of the ¼-wavelength semi-coaxial resonator on the input side according to a second exemplary embodiment.

FIGS. 13 and 14 are a perspective view and a sectional view, respectively, of the ¼-wavelength semi-coaxial resonator 25 on the input side, according to the present embodiments. The ¼ wavelength semi-coaxial resonator 26 on the output side (not shown) has a same structure as the ¼ wavelength semi-coaxial resonator 25 on the input side.

The TM mode dielectric resonator and the ¼ semi-coaxial resonator illustrated in FIGS. 7 and 8 have the same height, but the height of only the TM mode dielectric resonator portion may be low-profiled. The ¼ semi-coaxial resonators are included at both the input and output sides of the filter, but the filter according to this exemplary embodiment can be configured so that the ¼ semi-coaxial resonator is included only at the input side or the output side of the filter.

According to this exemplary embodiment, the resonators which configure the filter can be flexibly selected. Further, the spurious mode described above can be more suppressed by providing the ¼ wavelength semi-coaxial resonators near the input and output antennas.

Third Exemplary Embodiment

Figure 9:
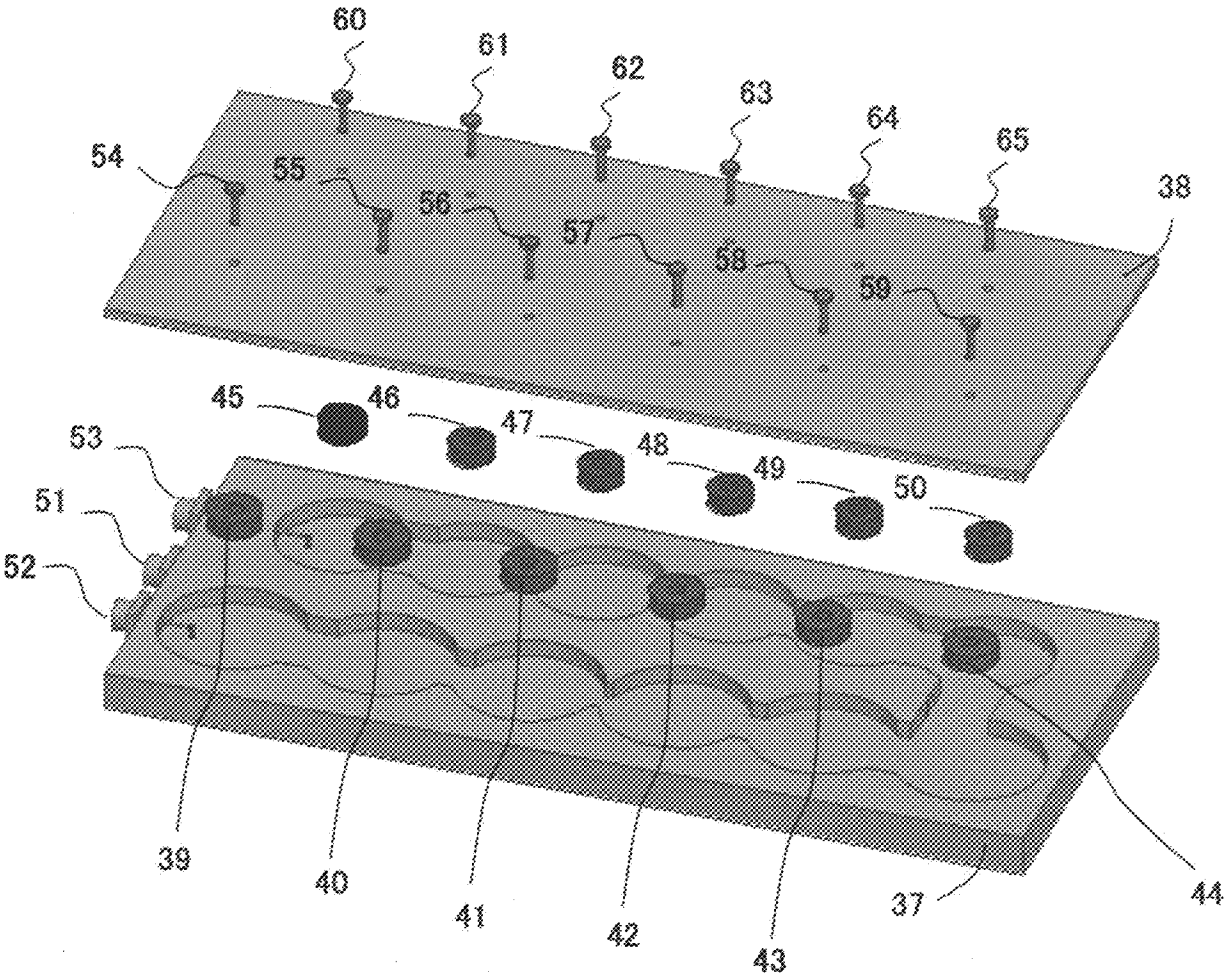
FIG. 9 is a perspective view of a branching filter according to a third exemplary embodiment.
Figure 10:
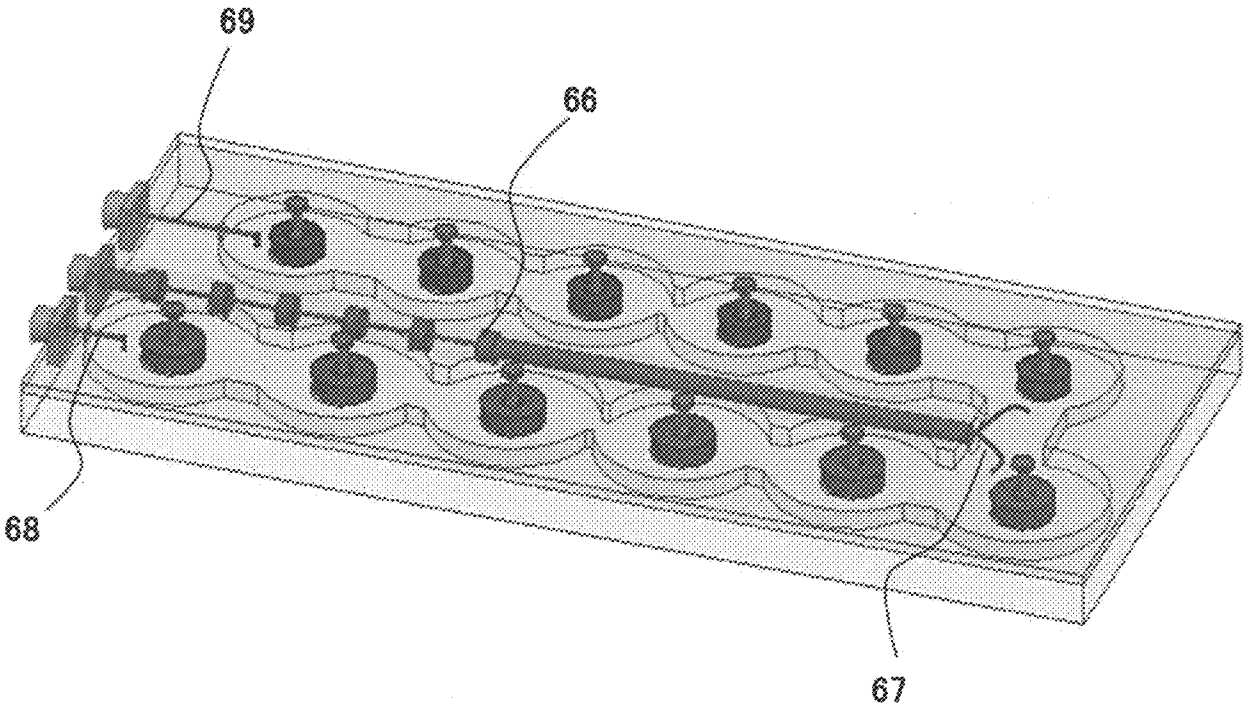
FIG. 10 is a transparent view of the branching filter according to the third exemplary embodiment.

FIG. 9 is a perspective view of a branching filter according to a third exemplary embodiment. FIG. 10 is a transparent view of FIG. 9. In the state illustrated in FIG. 10, the branching filter according to this exemplary embodiment operates.

The branching filter according to this exemplary embodiment includes a metallic casing 37 and a metallic cover 38 that covers an opening. The branching filter according to this exemplary embodiment also includes TM mode dielectric resonators which are interposed between the metallic casing 37 and the metallic cover 38.

The branching filter according to this exemplary embodiment includes TM mode dielectric resonators 39 to 44 on a reception-port-side and TM mode dielectric resonators 45 to 50 on a transmission-port-side. The metallic casing 37 also includes an antenna port 51, a reception port 52, and a transmission port 53. The metallic cover 38 includes frequency adjustment screws 54 to 59 for adjusting a resonance frequency frx of the TM mode dielectric resonators on the reception-port-side. The metallic cover 38 also includes frequency adjustment screws 60 to 65 for adjusting a resonance frequency ftx of the TM-mode dielectric resonators on the transmission-port-side. The metallic casing 37 also includes a low-pass filter (LPF) 66 for removing unwanted higher-order modes on the transmission side and the reception side of the branching filter. Note that the spurious mode is suppressed due to a low-profile resonator, and the low-pass filter 66 may not be necessarily included in this exemplary embodiment. When the low-pass filter 66 is included, unwanted higher-order modes can be removed more effectively.

An electromagnetic wave input from the antenna port 51 passes through the low-pass filter 66, unwanted higher-order modes on the reception side of the branching filter are removed, and a branched antenna 67 allows the electromagnetic wave to be electromagnetically coupled and input to the TM mode dielectric resonator 44. The TM mode dielectric resonator 44 is electromagnetically coupled to the adjacent (next) TM mode dielectric resonator 43, and propagates the electromagnetic wave. Finally, the TM mode dielectric resonator 39 is electromagnetically coupled to the output antenna 68, and the electromagnetic wave is output to the reception port 52.

On the other hand, an electromagnetic wave input from an amplifier or the like is input from the transmission port 53 to the input antenna 69, and is electromagnetically coupled and input to the TM mode dielectric resonator 45. The TM mode dielectric resonator 45 is electromagnetically coupled to the adjacent TM mode dielectric resonator 46, and propagates the input electromagnetic wave. Finally, the TM mode dielectric resonator 50 is electromagnetically coupled to the branched antenna 67, the electromagnetic wave passes through the low-pass filter 66, unwanted higher-order modes on the transmission side are removed, and then the electromagnetic wave is output to the antenna port 51.

Figure 11:
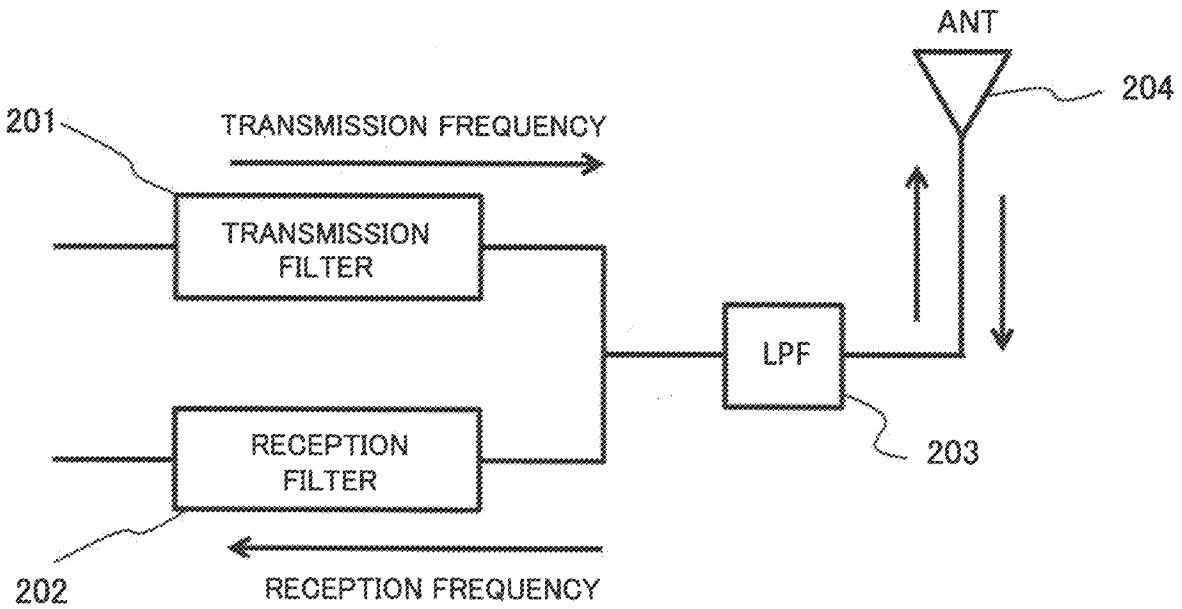
FIG. 11 is a block diagram of the branching filter according to the third exemplary embodiment.

FIG. 11 is a block diagram of the branching filter according to the third exemplary embodiment.

The branching filter according to this exemplary embodiment includes a transmission filter 201, a reception filter 202, a low-pass filter (LPF) 203, and an antenna (ANT) 204. In relation to an electromagnetic wave (signal) input from the antenna 204 in the low-pass filter 203, frequency components lower than a cutoff frequency are not likely to attenuate, and frequency components higher than the cutoff frequency (unwanted harmonic components) are gradually decreased (removed). The signal output from the low-pass filter 203 is input to the reception filter 202. The reception filter 202 allows only desired reception frequency components to pass through, and to be output to the reception port. An electromagnetic wave (signal) input from the transmission port passes through the transmission filter 201, and only desired transmission frequency components are allowed to pass through the transmission filter 201 and the low-pass filter 203 to be output from the antenna (ANT) 204 after unwanted harmonic components in the transmitted components are removed.

Note that the branching filter according to this exemplary embodiment can be installed in a wireless communication module of a wireless device such as a base station.

A low-profile branching filter can be provided by providing low-profile filters in parallel.

Fourth Exemplary Embodiment

Figure 12:
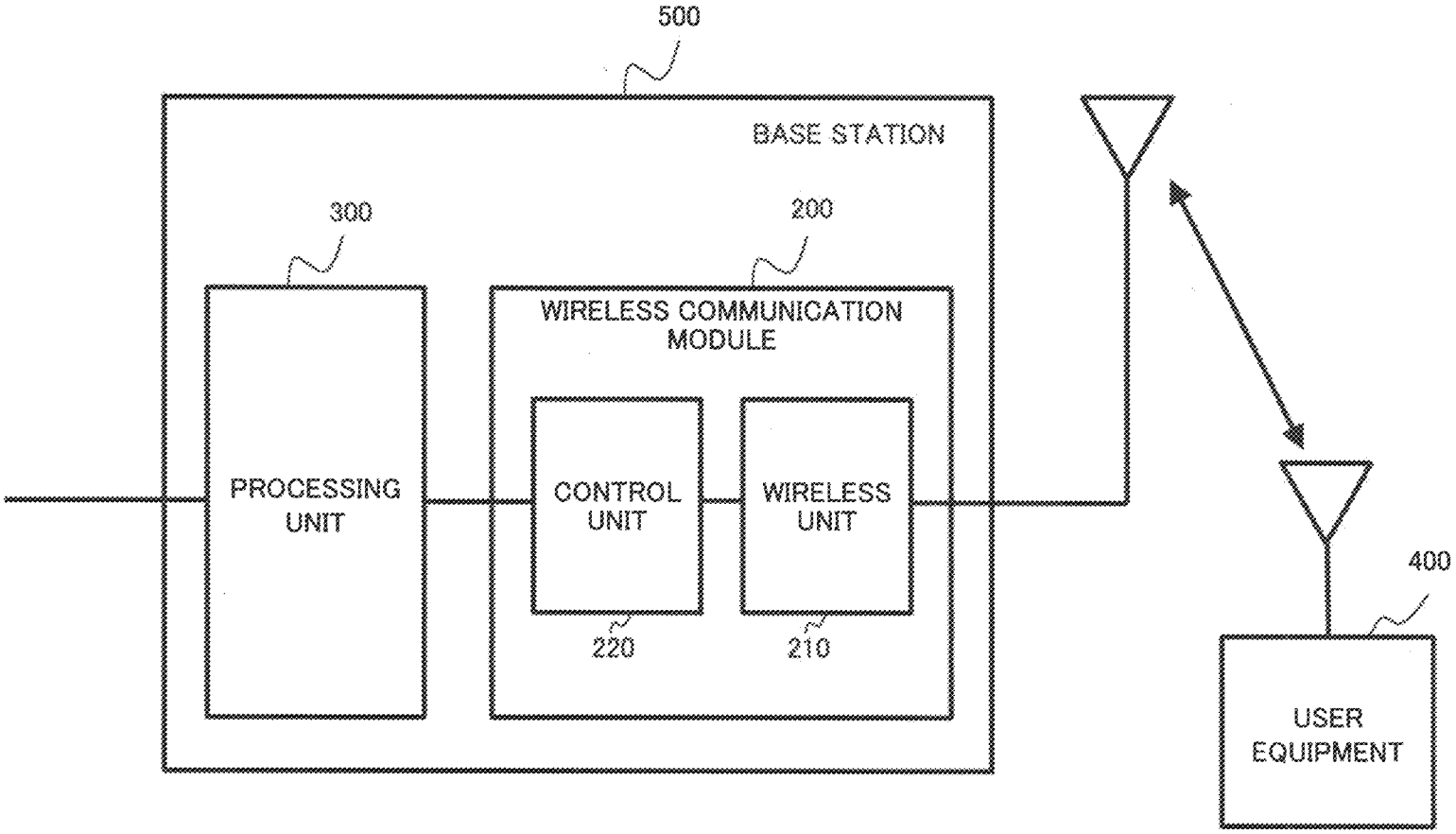
FIG. 12 is a block diagram of a base station according to a fourth exemplary embodiment.

FIG. 12 is a block diagram of a base station according to a fourth exemplary embodiment.

A base station 500 according to this exemplary embodiment is configured such that the base station can wirelessly communicate with user equipment 400. The base station 500 includes at least a wireless communication module 200 and a processing unit 300.

The wireless communication module 200 includes a wireless unit 210 and a control unit 220 that controls the wireless unit. The wireless unit 210 includes at least one filter or branching filter according to the exemplary embodiments described above, and other configurations used for wireless communication, such as a low-pass filter. The control unit 220 is also connected to the wireless unit 210, and processes a radio signal (a transmitted signal or a received signal) which is transmitted and received between the user equipment 400 and the base station 500. Specifically, the control unit 220 inputs a signal processed by a filter of the wireless unit 210, and transmits a signal received from the processing unit 300 to the wireless unit 210. The control unit 220 performs signal processing on the input signal and the output signal.

The processing unit 300 processes a signal which is transmitted to and received from the wireless communication module 200. The processing unit 300 transmits the signal received from the wireless communication module 200 to an upper-level device (such as a core network device and a gateway device), and transmits a signal (such as a baseband signal) received from the upper-level device to the wireless communication module.

The wireless communication module 200 is provided in the base station 500 integrally with the processing unit 300. The wireless communication module 200 may be disposed separately from the processing unit 300. For example, the wireless communication module 200 may be configured as an RRH (Remote Radio Head).

As described above, adoption of a low-profile filter or a low-profile branching filter in a wireless communication module and a base station achieves low-profiling and miniaturization of the wireless communication module and the base station.

According to the above exemplary embodiments, low-profiling of a filter leads to low-profiling and miniaturization of a branching filter, a wireless communication module, and a base station. Further, low-profiling and miniaturization lead to a weight reduction of the filter, the branching filter, the wireless communication module, and the base station. Furthermore, implementation with a simple configuration leads to a reduction of a processing cost.

Note that in the filter using the ¼ wavelength semi-coaxial resonator configured by a metal bar, large capacitive with a casing surface opposed to a resonance rod open-end leads to low-profiling thereof. The size of the ¼ wavelength semi-coaxial resonator is determined by a length of the resonance rod that is determined by a resonance wavelength of the resonance frequency. Accordingly, the height of the resonator cannot be reduced more than a certain height. Further, low-profiling causes degradation of a Q-value of the ¼ wavelength semi-coaxial resonator. Therefore, when a filter is configured only by the ¼ wavelength semi-coaxial resonator, a passage loss of the filter may deteriorate. This passage loss may cause an increase of power consumption of the base station using the filter. Furthermore, for example, in a base station using a frequency band from 700 MHz to 900 MHz, the size of the ¼ wavelength semi-coaxial resonator increases due to a low frequency. On the other hand, the filter according to the above exemplary embodiment uses the TM mode dielectric resonator, which suppresses degradation of the Q-value, and low-profiling of the resonator can be achieved. Therefore, degradation of an additional loss can be suppressed while achieving low-profiling of the filter.

Other Exemplary Embodiments

The present invention has been specifically described above based on exemplary embodiments. However, the present invention is not limited to the above exemplary embodiments, and can be modified in various ways without departing from the scope of the invention.

For example, the resonator (the TM mode dielectric resonator or the ¼ wavelength semi-coaxial resonator) according to the exemplary embodiments described above have a cylindrical shape. The shape of the resonator may be a polygonal prism such as a triangle pole, a square pole, and a pentagonal prism.

In the exemplary embodiments described above, the opening of the metallic casing has a circular groove, but may have a rectangular groove instead.

The base station according to the above exemplary embodiment will be described. The base station can be used for communication with one or more wireless terminals, and can include an access point, a node, an evolved Node B (eNB), or a part or the whole of functionalities of any other network entity. The base station communicates with UE (User Equipment) via an air interface. This communication may occur through one or more sectors. The base station converts a received air interface frame into IP packets, and thus the base station can operate as a router between the UE and a remaining access network which can include an internet protocol (IP) network. The base station can also adjust management of attributes for the air interface, and may be a gateway between a wired network and a wireless network. The base station may also be a macro base station that controls a macro cell, or may be a small cell base station (a femto base station, a home node base station) that controls a small cell.

The user equipment according to the above exemplary embodiment will be described. The user equipment can also be referred to as a user terminal, and can include a system, a subscriber unit, a subscriber station, a mobile station, a wireless terminal, a mobile device, a node, a device, a remote station, a remote terminal, a terminal, a wireless communication device, a wireless communication apparatus, or a part or the whole of functionalities of a user agent.

The user equipment may be another processing device that performs communication via a cellular phone, a cordless phone, a session initiation protocol (SIP) phone, a smartphone, a wireless local loop (WLL) station, a personal digital assistance (PDA), a laptop, a tablet, a netbook, a smartbook, a hand-held communication device, a hand-held computing device, a satellite radio, a wireless modem card and/or a wireless system.

In the above exemplary embodiments, processing for controlling each component provided in the filter, the branching filter, the wireless communication module, and the base station may be performed by a logic circuit respectively prepared according to an intended purpose.

Further, a computer program in which processing contents are described as procedures (hereinafter referred to as a program) may be recorded in a recording medium which is readable by each element configuring the wireless communication module or the base station, and the program recorded in the recording medium may be loaded into the wireless communication module or the base station to be executed.

The program recorded in the recording medium is loaded into a Central Processing Unit (CPU) provided in the wireless communication module or the base station, and processing similar to what is described above is performed by the control of the CPU. The CPU herein operates as a computer that executes the program loaded from the recording medium that records the program.

In the example described above, the program can be stored and provided to a computer by using various types of non-transitory computer readable media. Non-transitory computer readable media include various types of tangible storage media. Examples of the non-transitory computer readable media include magnetic storage media (such as floppy disks, magnetic tapes, and hard disk drives), magneto-optical storage media (such as magneto-optical disks), CD (Compact Disc)-ROM (Read Only Memory), CD-R (Recordable), CD-R/W (ReWritable), Digital Versatile Disk (DVD), and semiconductor memories (such as mask ROM, PROM (Programmable ROM), EPROM (Erasable PROM), flash ROM, and RAM (Random Access Memory)).

The program may be provided to a computer by means of various types of transitory computer readable media. Examples of the transitory computer readable media include electric signals, optical signals, and electromagnetic waves. The transitory computer readable media can provide the program to a computer via a wired communication line, such as an electric wire and an optical fiber, or a wireless communication line.

Note that the scope of the present invention is not limited to the exemplary embodiments illustrated in the drawings and described above, but includes all exemplary embodiments that have effects equivalent to those intended by the present invention. Further, the scope of the present invention can be achieved by any desired combination of specific features of the disclosed features.

This application is based upon and claims the benefit of priority from Japanese patent application No. 2014-150830, filed on Jul. 24, 2014, the disclosure of which is incorporated herein in its entirety by reference.

REFERENCE SIGNS LIST

1 Metallic casing
2 Metallic cover

3-8 TM mode dielectric resonators
9-14 Frequency adjustment screws
15 Input terminal
16 Input antenna
17 Output antenna
18 Output terminal
19 Metallic casing
20 Metallic cover
21, 22, 23, 24 TM mode dielectric resonators
25, 26 ¼ wavelength semi-coaxial resonators
27-32 Frequency adjustment screws
33 Input terminal
34 Input antenna
35 Output antenna
36 Output terminal
37 Metallic casing
38 Metallic cover
39-44 TM mode dielectric resonators
45-50 TM mode dielectric resonators
51 Antenna port
52 Reception port
53 Transmission port
54-59 Frequency adjustment screws
60-65 Frequency adjustment screws
66 Low-pass filter
67 Branched antenna
68 Output antenna
69 Input antenna
101 Metallic casing
102 Metallic cover
103 TM mode dielectric resonator
104 Frequency adjustment screw
105 Opening
106 Input terminal
107 Input antenna
108 Output antenna
109 Output terminal
200 Wireless communication module
201 Transmission filter
202 Reception filter
203 Low-pass filter
204 Antenna
210 Wireless unit
220 Control unit
300 Processing unit
400 User equipment
500 Base station

The invention claimed is:

1. A filter comprising:
a metallic casing;
an opening provided in the metallic casing;
a metallic cover configured to cover the opening; and
a TM mode dielectric resonator disposed in the opening and configured to electrically contact a bottom surface of the metallic casing, and the metallic cover,
wherein the TM mode dielectric resonator has a height lower than a lowest possible height at which a ¼ wavelength semi-coaxial resonator is disposed in the opening, the TM mode dielectric resonator comprises a cylinder or a polygonal prism, and when the TM mode dielectric resonator comprises the cylinder, the height of the TM mode dielectric resonator is less than an outer diameter of the TM mode dielectric resonator.

2. The filter according to claim 1, wherein the opening is provided with a plurality of the TM mode dielectric resonators.

3. A branching filter comprising:
an antenna;
a transmission filter configured to filter a transmitted signal and output the filtered signal to the antenna; and
a reception filter configured to filter a received signal from the antenna,
wherein one of the transmission filter and the reception filter comprises:
a metallic casing;
an opening provided in the metallic casing;
a metallic cover configured to cover the opening; and
a TM mode dielectric resonator disposed in the opening and configured to electrically contact a bottom surface of the metallic casing and the metallic cover, and wherein the TM mode dielectric resonator has a height lower than a lowest possible height at which a ¼ wavelength semi-coaxial resonator is disposed in the opening and is configured by a cylinder or a polygonal prism, wherein, when the TM mode dielectric resonator is configured by the cylinder, the height of the TM mode dielectric resonator is less than an outer diameter of the TM mode dielectric resonator.

4. The branching filter according to claim 3, further comprising a low-pass filter configured to remove an unwanted higher-order mode related to one of the transmitted signal and the received signal.

5. A filter comprising:
a metallic casing;
an opening provided in the metallic casing;
a metallic cover configured to cover the opening;
a TM mode dielectric resonator disposed in the opening and configured to electrically contact a bottom surface of the metallic casing and the metallic cover and further configured by a cylinder or a polygonal prism, and wherein, when the TM mode dielectric resonator is configured by a cylinder, a height of the TM mode dielectric resonator is less than an outer diameter of the TM mode dielectric resonator; and
a ¼ wavelength semi-coaxial resonator disposed in the opening and configured to electrically contact a bottom surface of the metallic casing and the metallic cover, wherein the ¼ wavelength semi-coaxial resonator is used as one of an input resonator and an output resonator.

* * * * *